US005412919A

United States Patent [19]

Pellock et al.

[11] Patent Number: 5,412,919

[45] Date of Patent: May 9, 1995

[54] METAL WALL FRAMING

[75] Inventors: Michael A. Pellock, Edwardsville, Ill.; Arturo P. Sordo, St. Louis, Mo.

[73] Assignee: MiTek Holdings, Inc., Wilmington, Del.

[21] Appl. No.: 171,229

[22] Filed: Dec. 21, 1993

[51] Int. Cl.[6] ..... E04B 2/60

[52] U.S. Cl. ..... 52/656.1; 52/241; 52/243; 52/690

[58] Field of Search ..... 52/92.1, 241, 242, 243, 52/281, 293.3, 481.1, 650.1, 653.1, 656.1, 660, 664, 690, 731.2, 731.9

[56] References Cited

U.S. PATENT DOCUMENTS

| | | | |
|---|---|---|---|
| 2,023,814 | 12/1935 | Lindsey | 52/243 |
| 2,105,771 | 1/1938 | Holdsworth | 52/656.1 X |
| 2,776,080 | 1/1957 | Hopfeld | 52/690 |
| 3,039,569 | 6/1962 | Bohnsack | 52/656.1 X |
| 3,289,368 | 12/1966 | Mark | 52/731.2 X |
| 3,460,320 | 8/1969 | Cooper | 52/242 |
| 3,845,601 | 11/1974 | Kostecky | 52/656.1 X |
| 3,983,670 | 10/1976 | Lightfoot | 52/241 X |
| 4,038,799 | 8/1977 | Shanks | 52/241 |
| 5,020,290 | 6/1991 | Hajjar | 52/242 |
| 5,127,760 | 7/1992 | Brady | 52/241 |
| 5,218,803 | 6/1993 | Wright | 52/664 X |
| 5,222,335 | 6/1993 | Petrecca | 52/241 X |
| 5,313,752 | 5/1994 | Hatzinikolas | 52/690 X |

OTHER PUBLICATIONS

Low-rise Residential Construction Details published Jun. 1993 by The American Iron and Steel Institute-page entitled "Top Track Distribution Member".

*Primary Examiner*—Carl D. Friedman
*Assistant Examiner*—Kevin D. Wilkens
*Attorney, Agent, or Firm*—Senniger, Powers, Leavitt & Roedel

[57] ABSTRACT

A metal wall framing section comprising top and bottom tracks and studs, each formed of sheet metal, the top track comprising a downwardly facing outer channel and an upwardly facing inner channel nested in the outer channel and forming therewith a box beam for taking the load of roof trusses bearing on the top track between studs.

5 Claims, 3 Drawing Sheets

15
17
3
39
19
19
27
25
19a
27
25
21
23
19a
35
W
7
29
31
31
33
33
31
7
11
11
29
37
5
9

METAL WALL FRAMING

BRIEF SUMMARY OF THE INVENTION

This invention relates to metal wall framing, and more particularly to a metal wall framing section comprising top and bottom members, which are referred to as "tracks," and studs all formed of sheet metal.

The invention involves an improvement on a prior type of sheet metal wall framing section comprising top and bottom sheet metal channels, the top channel facing down and the bottom channel facing up, with studs constituted by sheet metal channels, each stud having its upper end extending into the top channel, with the web of each stud extending transversely with respect to the top and bottom channels and with the flanges of each stud on the inside of the flanges of the top and bottom channels and fastened thereto by self-tapping sheet metal screws driven through the flanges of the top and bottom channels into the flanges of the stud. In general, such sections are used for the walls of the building, two of the sections being erected spaced apart and extending parallel to one another on a foundation structure with the bottom channel bearing on the foundation structure, and roof trusses set in place bearing on the top channels of the two sections and spanning the latter. Where possible, each roof truss is set in place bearing adjacent the heels of the truss on the top channels of the two sections at the upper end of a stud of one of the sections and at the upper end of a stud of the other section so that the load of the truss is borne directly by the studs rather than by portions of the top channel which extend between two studs. In certain instances, however, it is desired to set trusses in place on the top tracks of the two sections offset from studs of the two sections, i.e. with a truss bearing on the top channel at a point between the upper ends of two of the studs, so that the load of the truss is borne by the portion of the top channel between the two studs acting as a beam, and transferred thereby to the two studs. In certain of said offset truss constructions, if the top channel is formed of sheet steel of practical thickness, it may not have adequate beam strength between studs to take the load of a truss bearing on the top channel between two studs.

Accordingly, among the several objects of this invention may be noted the provision of an improved metal wall framing section of the type described with a special reinforced top track construction imparting adequate beam strength to the top track to enable it to take the load of roof trusses which are offset from the studs; and the provision of such a construction for the upper track utilizing components formed of sheet steel of practical gauge which is economical as to said components and as to fabrication of said components into the section.

In general, a metal wall framing section of this invention comprises spaced apart top and bottom tracks and a plurality of parallel elongate stud means formed of sheet metal extending between the top and bottom tracks spaced at intervals along the length of the tracks. The upper track comprises a first sheet metal channel member which opens downwardly in the erected position of the section, said first channel member having a web which constitutes the top of the section as erected and flanges extending down from the web at opposite sides thereof, and a second sheet metal channel member inside the first. The second channel member opens upwardly, having a web spaced downwardly from the web of the first channel member and flanges extending up from the web of the second channel member at opposite sides thereof. The flanges of the first channel member are wider than the flanges of the second channel member. The flanges of the second channel member extend up to the web of the first channel member, the two channel members forming a box beam. The flanges of the first channel member have portions extending down below the flanges of the second channel member. One end of each stud means constituting its upper end extends up between and is secured to said portions of the first channel member and engages the bottom face of the web of the second channel member, and the flanges of the first and second channel members are secured together, the section being adapted for application to the upper track of structure at positions not in alignment with the stud means.

Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION

Figure 1:
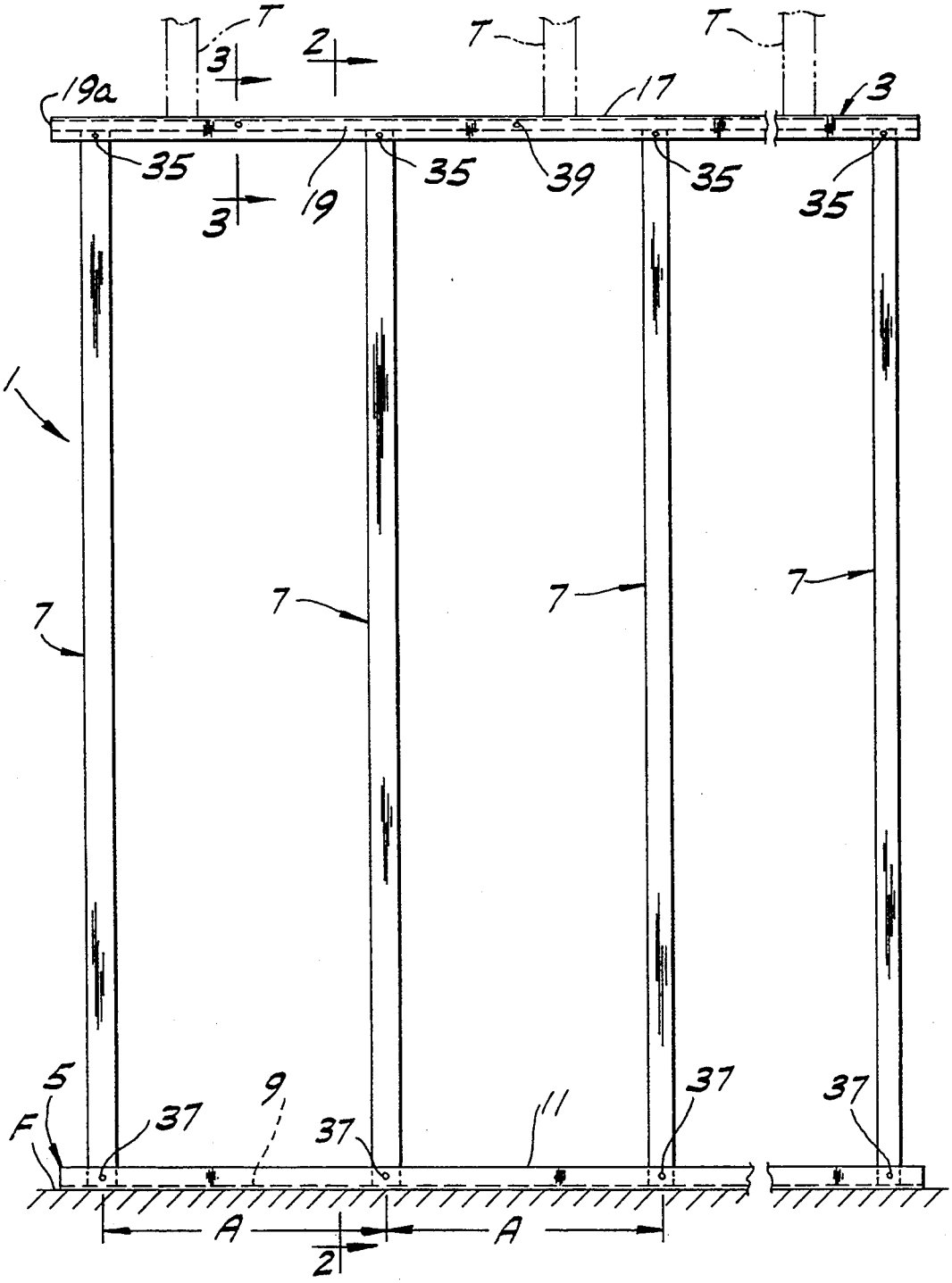
FIG. 1 is a view in elevation of a metal wall framing section of this invention showing the section as erected on a foundation structure, with parts broken away, and showing in phantom roof trusses bearing on the top track of the section offset from the studs of the section.
Figure 2:
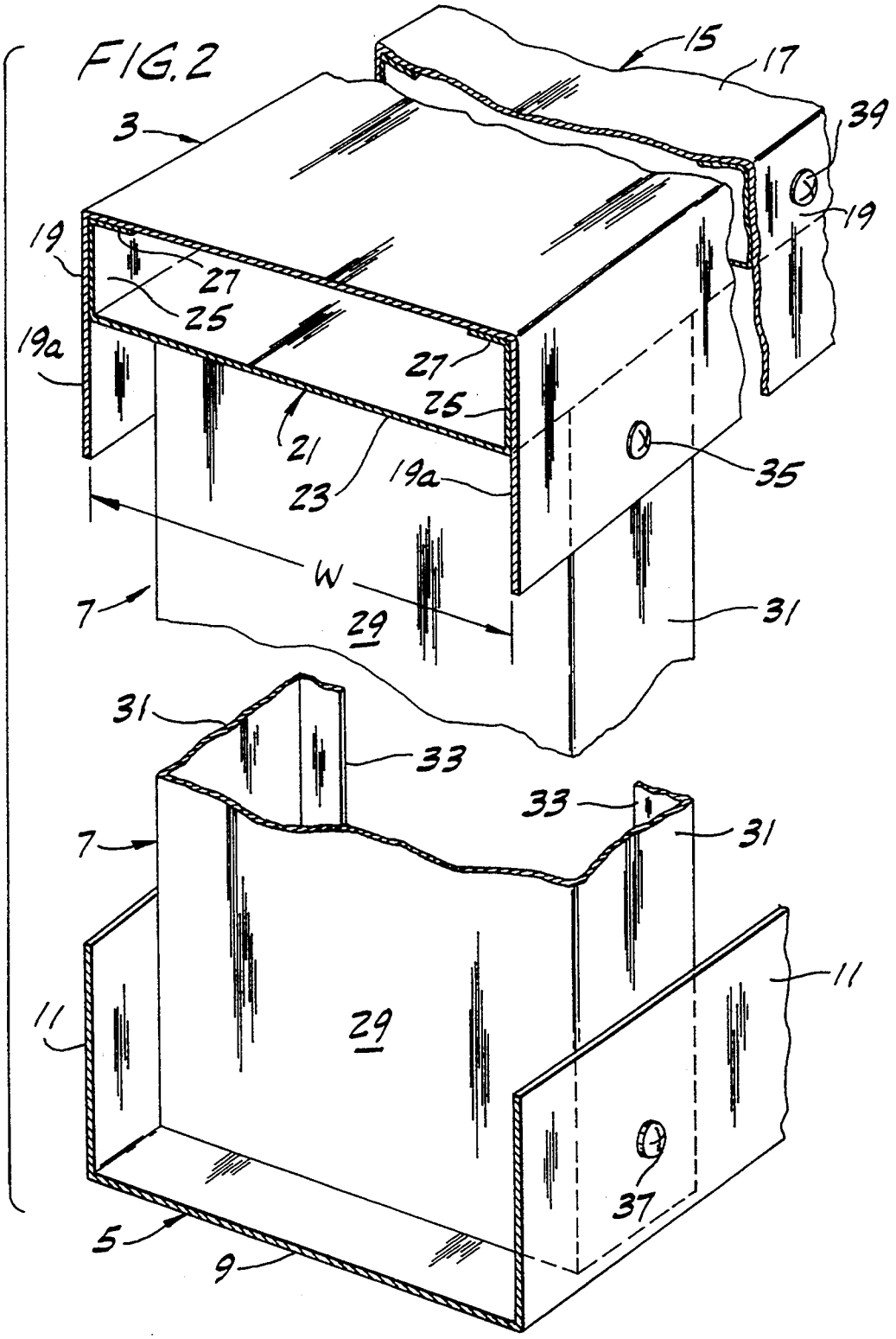
FIG. 2 is a perspective in section on line 2—2 of FIG. 1.
Figure 3:
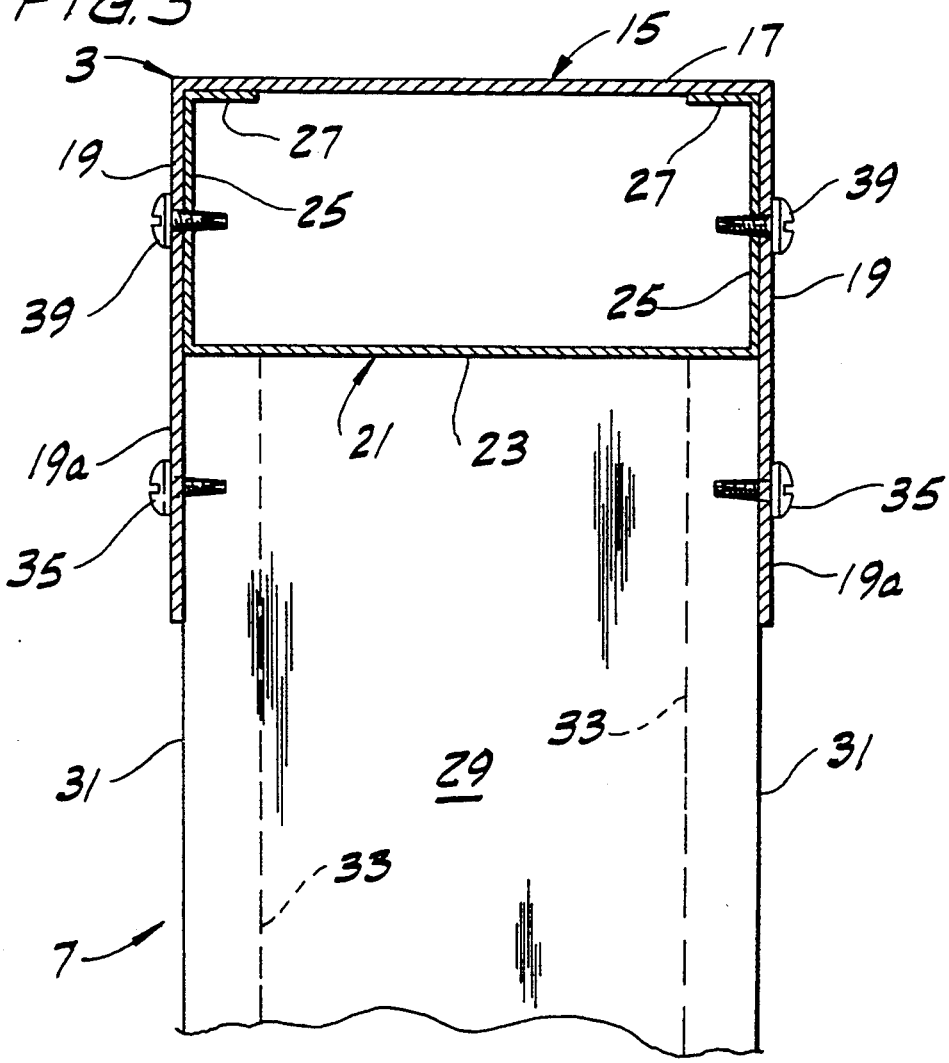
FIG. 3 is a vertical section on line 3—3 of FIG. 1.

Referring to the drawings, a metal wall framing section of this invention, designated 1 in its entirety, is shown to comprise spaced apart elongate top and bottom members or tracks 3 and 5 extending parallel to one another and a plurality of parallel elongate stud means each designated 7 formed of sheet metal extending between the top and bottom tracks generally at right angles thereto spaced at intervals indicated at A in FIG. 1 along the lengths of the top and bottom members. The section 1, which may be fabricated in a plurality of standard lengths and standard heights, is used in constructing walls of a building, with special use for load-bearing outside walls which support roof trusses or other roof structure, though not limited to such use. As erected, the section stands vertical, with the bottom member 5 extending horizontally bearing on suitable supporting structure F, more particularly a slab or other foundation structure. The section may be fabricated in various lengths with as many stud means 7 as needed. The stud means extends vertically upward from the bottom member spaced at appropriate stud intervals, and the top member as herein illustrated extends horizontally over the upper ends of the stud means.

The bottom track 5 is of C-shape in cross-section, being constituted by a channel member formed of sheet metal, its web being designated 9 and its flanges being designated 11. In the erected position of the section 1, the web 9 extends horizontally at the bottom of the section, and the flanges 11 extend upwardly at opposite sides of the web. The bottom track is generally the same as the bottom member of the prior art metal wall framing section described above.

The top track 3 is of a special construction in accordance with this invention, comprising a first member 15 of C-shape in cross-section, constituted by a channel member formed of sheet metal, its web being designated 17 and its flanges being designated 19. In the erected position of the section 1, the web 17 extends horizontally and the flanges 19 extend downwardly at opposite sides of the web 17. The width of the channel 15 between the inside faces of its flanges 19 is indicated at W. The top track 3 further comprises a second member 21 of C-shape in cross-section, constituted by a channel member formed of sheet metal, its web being designated 23 and its flanges being designated 25. The latter have inwardly extending lips 27 at their outer edges. The second channel member 21 is fitted inside the first channel member 15, its outside width (which is also indicated at W) being such as to enable nesting it in the first channel member with a relatively tight fit. In the erected position of the section 1, the first channel member 15 of the top track 3 is at the top of the section, with its web 17 extending horizontally at the top of the section and its flanges 19 extending downwardly on opposite sides of the second channel member 21. Thus, the first channel member may be referred to as opening downwardly. The second channel member 21 is nested in the first with its flanges 25 extending upwardly on the inside of flanges 19 with the outside faces of flanges 25 generally in face-to-face engagement with the inside faces of flanges 19, and with the lips 27 at the upper edges of flanges 25 engaging the bottom face of the web 17 of the first channel member 15. The two channel members 15 and 21, the one opening downwardly and the other opening upwardly, form a box beam spanning the struts at the upper ends of the struts. The webs 17 and 23 form the top and bottom of the box beam; the flanges 19 and 25 at each side form a double-thickness side wall of the box beam. The flanges 19 of the first channel member 21 are appreciably wider than the flanges 25 of the second channel member and thus have lower portions 19*a* extending down below the flanges 25.

Each stud means 7 is a single stud constituted by an elongate member of C-shape in cross-section, i.e., a channel member formed of sheet metal, its web being designated 29 and its flanges 31. The latter have inwardly extending lips 33 at their outer edges. The width of the channel member 7 corresponds to the outside width W of the second (inside) channel member 21 and to the inside width W of the first (outside) channel member 15 between the inside faces of its flanges 17. One end of each channel member 7 constituting its upper end extends up between and is secured to the said lower portions 19*a* of the flanges 19 of the first channel member 15, the securement being shown as by means of self-tapping sheet metal screws 35 driven through said portions 19*a* into the flanges 25 of the channel members 7 (the studs). The other end (the lower end) of each channel member (stud) 7 extends between and has its flanges 31 secured to the flanges 11 of the bottom track 3 at both sides, the securement being shown as by means of self-tapping sheet metal screws 37. The flanges 19 of the outside channel member 15 are secured to the flanges 25 of the inside channel member 21 at both sides as by means of self-tapping sheet metal screws 37. The upper ends of the studs engage the web 23; the lower ends of the studs engage the web 9.

For increasing the beam strength of the top track 3, the outside channel member 15 may be formed of thicker sheet steel than the inside channel member 21, the bottom channel member 5 and the studs 7. Thus, the inside channel member the bottom channel member and the studs may be formed of 20 gauge sheet steel and the outside channel of 16 gauge sheet steel.

In general, in erecting a building, two of the wall framing sections 1 are erected spaced apart and extending vertically and parallel to one another on a foundation structure F, e.g., a slab, with the bottoms of the sections bearing on the foundation structure and secured thereto as by bolting the web of the bottom channel to the foundation structure by anchor bolts embedded therein. Roof trusses such as indicated at T in FIG. 1 may be set on top of the top channel member 15 of the two sections 1 spanning the latter in vertical planes transverse to the sections and offset from the vertical transverse planes of the studs, i.e. bearing on the top channel member 15 at points between studs 7. The portion of the top track 3 between two studs 7 functions as a box beam spanning the two studs acting as columns supporting the box beam, the latter being of adequate strength while comprising components 15 and 21 of economical practical gauge and adapted for economical fabrication with the section 1.

While the stud means 7 is shown as a single stud constituted by an elongate member of C-shape in cross-section, i.e., a channel, it will be understood that other stud means may be used, such as a single stud formed of sheet metal having a general "I" shaped cross-section, or a double stud comprising two separately formed C-shaped members arranged back to back, opening in opposite directions and secured together as by means of sheet metal screws.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A metal wall framing section comprising spaced apart top and bottom tracks and a plurality of parallel elongate stud means formed of sheet metal extending between the top and bottom tracks spaced at intervals along the length of the tracks, the upper track comprising a first sheet metal channel member which opens downwardly in the erected position of the section, said first channel member having a web which constitutes the top of the section as erected and flanges extending down from the web at opposite sides thereof, and a second sheet metal channel member inside the first, said second channel member opening upwardly having a web spaced downwardly from the web of the first channel member and flanges extending up from the web of the second channel member at opposite sides thereof, the flanges of the first channel member being wider than the flanges of the second channel member, the flanges of the second channel member extending up to the web of the first channel member, the two channel members forming a box beam, the flanges of the first channel member having portions extending down below the flanges of the second channel member, one end of each stud means constituting its upper end extending up between and secured to said portions of the first channel member and engaging the bottom face of the web of the second channel member, and the flanges of the first and second channel members being secured together, the section being adapted for application to the upper track of structure at positions not in alignment with the stud means.

2. A metal wall framing section as set forth in claim 1 wherein each stud means comprises a sheet metal channel having a web and flanges extending from the web at opposite sides thereof, the flanges of each stud means extending at the upper end of the stud means between the downwardly extending portions of the said first channel member on the inside of said downwardly extending portions generally in face-to-face engagement therewith, and secured to said downwardly extending portions by self-tapping sheet metal screws driven through said downwardly extending lower portions and the flanges of the stud means.

3. A metal wall framing section as set forth in claim 2 wherein the flanges of the first and second channel members are secured together by self-tapping sheet metal screws driven through the flanges of said first channel member and the flanges of the second channel member.

4. A metal wall framing section as set forth in claim 1 wherein the flanges of said second channel member have inwardly extending lips at their outer edges engaging the web of the first channel member.

5. A metal wall framing section as set forth in claim 1 wherein the first channel member is formed of sheet metal thicker than that forming said second channel.

* * * * *